United States Patent [19]

Tiffany

[11] Patent Number: 4,583,467

[45] Date of Patent: Apr. 22, 1986

[54] CONVERTIBLE TABLES

[75] Inventor: H. Robert Tiffany, Philadelphia, Pa.

[73] Assignee: Tiffany and Tiffany, Philadelphia, Pa.

[21] Appl. No.: 396,941

[22] Filed: Jul. 9, 1982

[51] Int. Cl.[4] ..... A47B 3/00

[52] U.S. Cl. ..... 108/19; 108/12

[58] Field of Search ..... 108/12, 19, 115, 11

[56] References Cited

U.S. PATENT DOCUMENTS

| | | | |
|---|---|---|---|
| 633,203 | 9/1899 | Makinen . | |
| 683,069 | 9/1901 | Pugh . | |
| 777,186 | 12/1904 | Dittmar . | |
| 2,329,213 | 9/1943 | Neutra et al. . | |
| 2,560,821 | 7/1951 | Reiman et al. . | |
| 2,743,978 | 5/1956 | Shore . | |
| 3,020,111 | 2/1962 | Berliner | 108/19 |
| 3,087,442 | 4/1963 | Berliner | 108/19 |
| 3,147,052 | 9/1964 | Carr et al. . | |
| 4,106,413 | 8/1978 | Hoaglund | 108/19 |
| 4,259,909 | 4/1981 | Belina . | |

FOREIGN PATENT DOCUMENTS 595851 10/1925 France .

*Primary Examiner*—William E. Lyddane
*Assistant Examiner*—Peter A. Aschenbrenner
*Attorney, Agent, or Firm*—Seidel, Gonda, Goldhammer

[57] ABSTRACT

A convertible table is comprised of a central planar section and two end sections. The end sections are hingedly secured to the central planar section for rotation thereabout. Each end section has a pair of legs fixedly secured thereto. The legs are not capable of movement with respect to the end sections, but rotate with the end sections.

Utilizing the aforementioned approach, a number of table designs are possible. For example, to facilitate folding, the pair of legs attached to one end section may have a greater distance therebetween than does the pair of legs attached to the other end section. In this manner, when the end sections are folded to a position perpendicular to the central planar section, a coffee table, or cocktail table or the like having a lower overall height is formed. The end sections support the central planar section and also form two sides of the table. The legs form the other two sides of the table and may also support the central planar section.

2 Claims, 20 Drawing Figures

FIG. 6
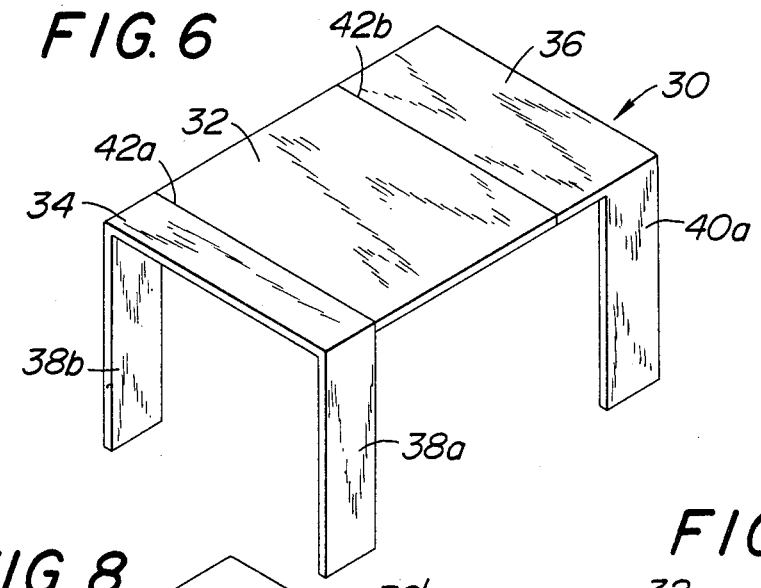
FIG. 8
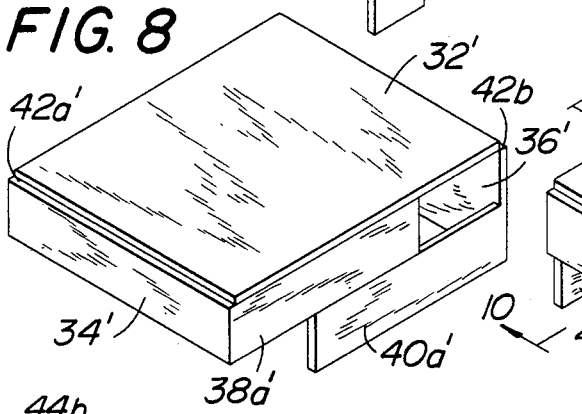
FIG. 7
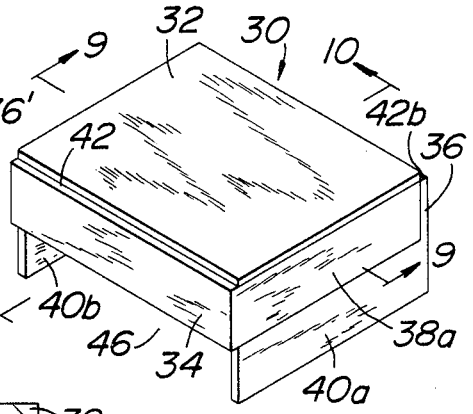
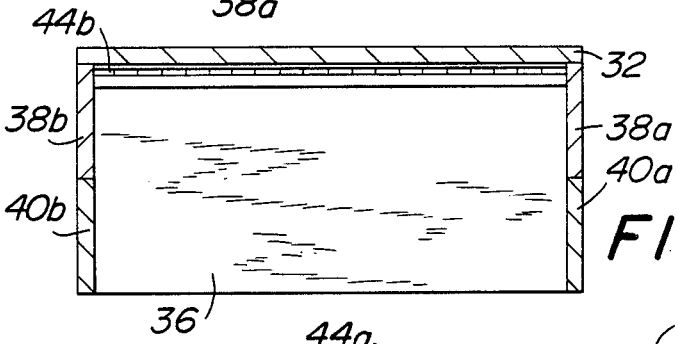
FIG. 9
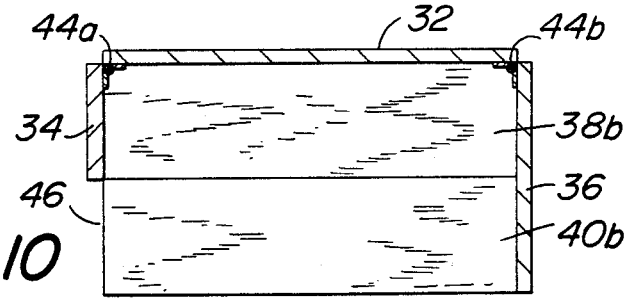
FIG. 10

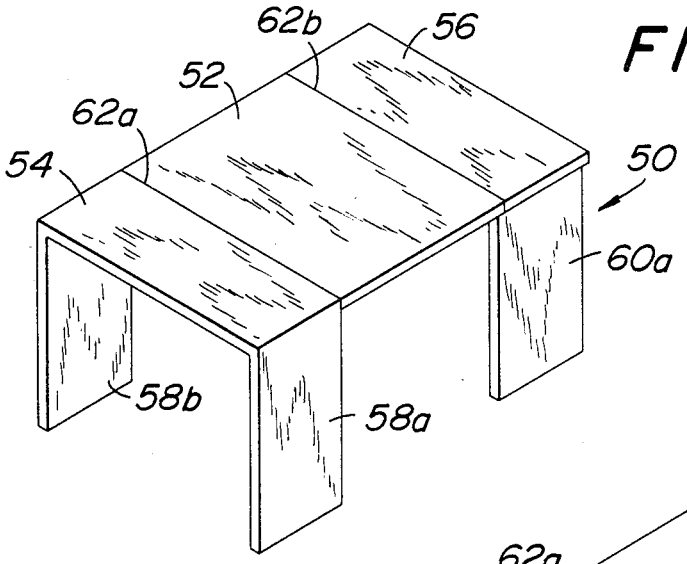
FIG. 11
FIG. 12
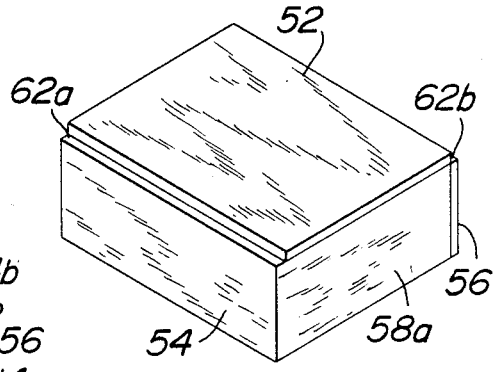
FIG. 13
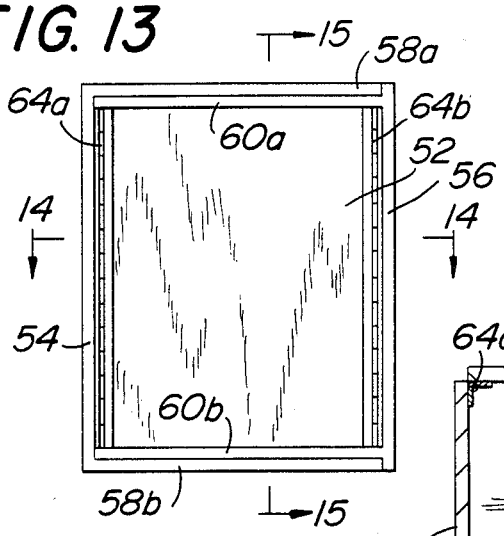
FIG. 14
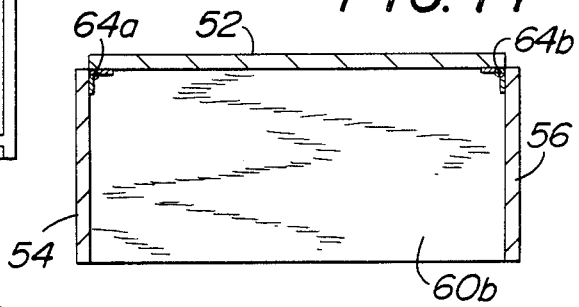
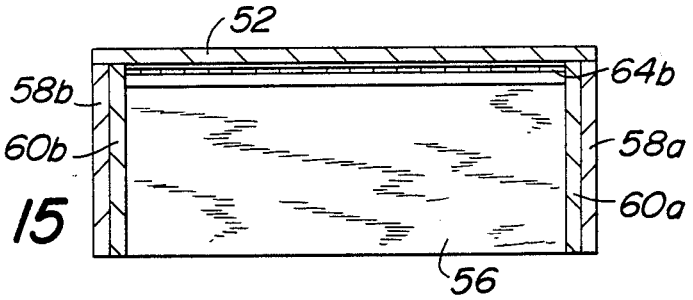
FIG. 15

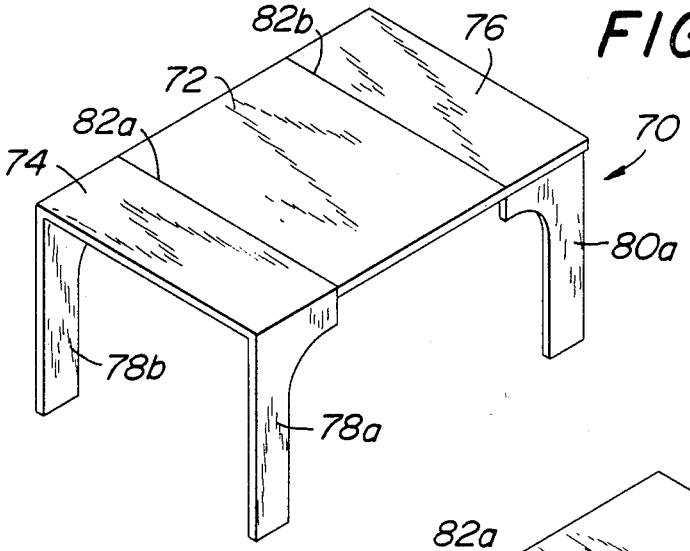
FIG. 16
FIG. 17
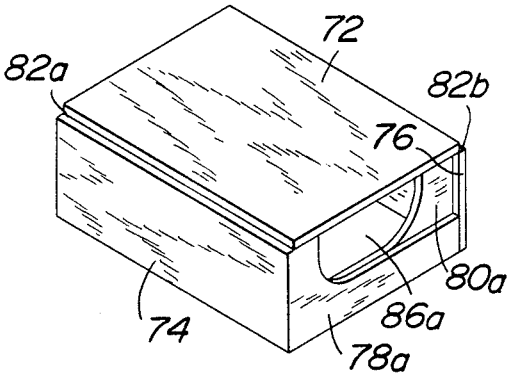
FIG. 18
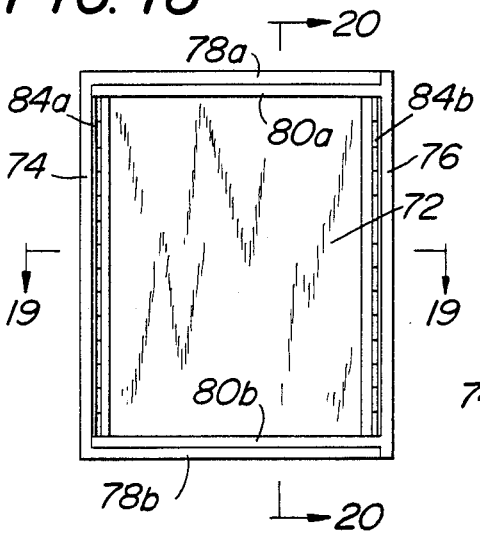
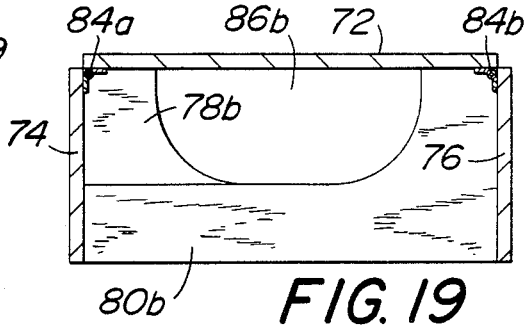
FIG. 19
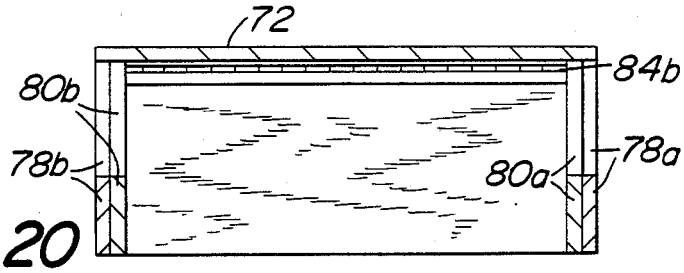
FIG. 20

CONVERTIBLE TABLES

BACKGROUND OF THE INVENTION

The present invention relates to tables which are convertible between two positions. In the first position, the table is suitable for use as a standard dining table and can accommodate one or more standard height dining chairs. In the second position, the table is folded and can be used as either a cocktail table, coffee table or the like.

Tables which are convertible from one position to another are known in the art. For example, tables having insertable leaves wherein the length of the top of the table can be increased are common. Such tables are often constructed in "halves" such that the halves are pulled apart and the leaves inserted. However, these tables are not convertible to another position suitable for use as a coffee table or cocktail table.

Other tables have folding legs such that the legs can be either snapped into an upright position to form a dining table or card table or snapped into another position to facilitate storage of the table. Such tables do not readily lend themselves for use as coffee tables or cocktail tables.

Still other tables are convertible between two or more positions but require that several table elements be maneuvered in order to make the transition from one position to another. Thus, in addition to being cumbersome, such tables are unnecessarily expensive.

It is therefore desirable to provide a table which is convertible from a standard-sized dining table to a cocktail table, coffee table or the like with only a minimum of effort and a minimum of hardware. It is also desirable that such a table have an aesthetically pleasing appearance.

SUMMARY OF THE INVENTION

A convertible table is comprised of a central planar section and two end sections. The end sections are hingedly secured to the central planar section for rotation thereabout. Each end section has a pair of legs fixedly secured thereto. The legs are not capable of movement with respect to the end sections, but rotate with the end sections.

Utilizing the aforementioned approach, a number of table designs are possible. For example, to facilitate folding, the pair of legs attached to one end section may have a greater distance therebetween than does the pair of legs attached to the other end section. In this manner, when the end sections are folded to a position perpendicular to the central planar section, a coffee table, or cocktail table or the like having a lower overall height is formed. The end sections support the central planar section and also form two sides of the table. The legs form the other two sides of the table and may also support the central planar section.

Alternatively, one end section may have a greater overall width than the other end section. The pair of legs attached to one end section has substantially the same distance therebetwen as the legs attached to the other end section. However, the pair of legs attached to the end section having the greater overall width are attached at a location adjacent the outside longitudinal edge of this end section. In this manner, when the end sections are rotated to a position substantially perpendicular to the central planar section, a table having an overall shorter height is formed. The legs attached to the end section having the lesser overall width abut the bottom of the central planar section and rest upon the legs attached to the end section having the greater overall width. The legs attached to the wider end section form the base of the table when it is folded.

The invention allows a number of other alternative table designs. For example, each of the legs may have a greater overall width at their base than at their feet. Such a design provides an aesthetically pleasing appearance when the table is folded into the cocktail table or coffee table position.

BRIEF DESCRIPTION OF THE DRAWINGS

For the purpose of illustrating the invention, there is shown in the drawings a form which is presently preferred; it being understood, however, that that this invention is not limited to the precise arrangements and instrumentalities shown.

FIG. 6 is a perspective view of another embodiment of a table according to the invention and illustrates the table in its first position.

FIG. 7 is a perspective view of the table illustrated in FIG. 6 folded to its second position.

FIG. 8 illustrates an another embodiment of the table illustrated in FIGS. 6 and 7.

FIG. 9 is a detail sectional view taken along line 9—9 of FIG. 7.

FIG. 10 is a detail sectional view taken along line 10—10 of FIG. 7.

FIG. 11 is a perspective view of still another embodiment of a table according to the invention and illustrates the table in its first position.

FIG. 12 is a perspective view of the table illustrated in FIG. 11 folded to its second position.

FIG. 13 a bottom plan view of the folded table illustrated in FIG. 12.

FIG. 14 is a detail sectional view taken along line 14—14 of FIG. 13.

FIG. 15 is a detail sectional view taken along line 15—15 of FIG. 13.

FIG. 16 is a perspective view of still another embodiment of the invention and illustrates the table in its first position.

FIG. 17 is a perspective view of the table illustrated in FIG. 16 folded to its second position.

FIG. 18 is a bottom plan view of the folded table illustrated in FIG. 17.

FIG. 19 is a detail sectional view taken along line 19—19 of FIG. 18.

FIG. 20 is a detail sectional view taken along line 20—20 of FIG. 18.

DETAILED DESCRIPTION OF THE INVENTION

Figure 1:
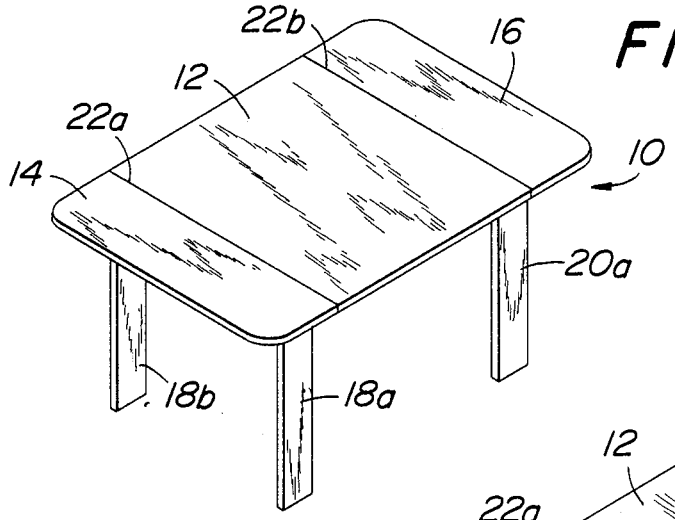
FIG. 1 is a perspective view of one embodiment of a table according to the invention and illustrates the table in its first position.

Referring now to the drawings wherein like numerals indicate like elements, there is shown in FIG. 1 one embodiment of a convertible table 10 constructed according to the principles of the present invention. Table 10 is comprised of a central planar section 12 and two end sections 14 and 16. The table is supported by a plurality of legs 18*a*, 18*b*, 20*a* and 20*b*. Legs 18*a* and 18*b* are fixedly secured to end section 14 and the legs 20*a* and 20*b* are fixedly secured to end section 16. As will be described in further detail, end sections 14 and 16 are hingedly secured to central planar section 12 at locations 22*a* and 22*b* to allow rotational movement thereabout.

As illustrated in FIG. 1, when the table is in its first position, end sections 14 and 16 are rotated so that they are in the same plane as central planar section 12, thereby increasing the overall size of the top of table 10. When end sections 14 and 16 have been thus rotated, legs 18*a*, 18*b*, 20*a* and 20*b* support the table 10 as shown. End sections 14 and 16 are maintained in planar relationship with central planar section 12 because the mating edges of central planar section 12 and end sections 14 and 16 abut at seams 22*a* and 22*b* respectively to prevent any further rotation.

Figure 2:
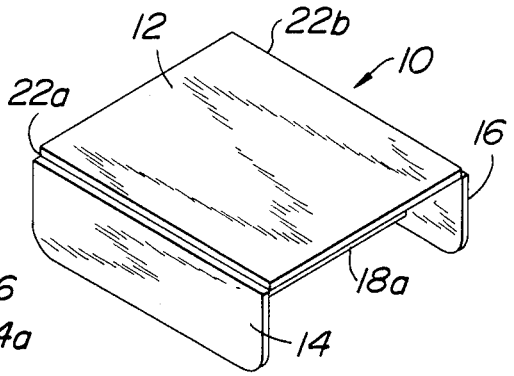
FIG. 2 is a perspective view of the table illustrated in FIG. 1 folded to its second position.

As seen in FIG. 2, the table 10 can be converted to a second position having a substantially lower height than the first position illustrated in FIG. 1. The table position shown in FIG. 2 is suitable for use as a coffee table, cocktail table, etc. When the table is in the position shown in FIG. 2, end sections 14 and 16 are in a position substantially perpendicular to central planar section 12. End sections 14 and 16 also serve to support the central planar section 12 as shown. The legs 18*a*, 18*b*, 20*a* and 20*b* abut the bottom of central planar section 12 and provide further support for the central planar section 12. The abutment of legs 18*a*, 18*b*, 20*a* and 20*b* against the bottom of central planar section 12 also prevents the end sections 14 and 16 from rotating to a position underneath central planar section 12 and therefore prevents the table 10 from collapsing.

Figure 3:
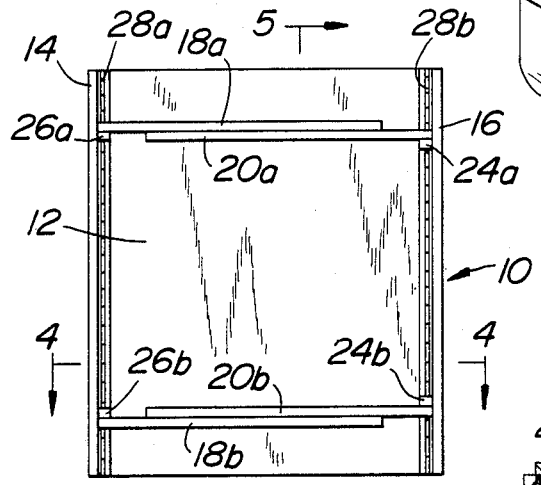
FIG. 3 is a bottom plan view of the folded table illustrated in FIG. 2.
Figure 4:
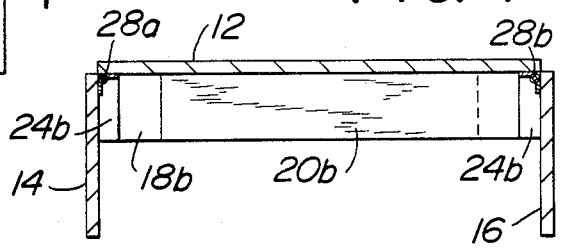
FIG. 4 is a detail sectional view taken along line 4—4 of FIG. 3.
Figure 5:
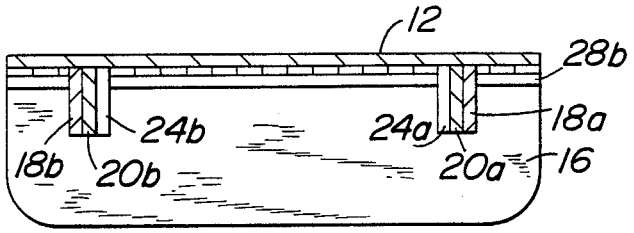
FIG. 5 is a detail sectional view taken along line 5—5 of FIG. 3.

FIGS. 3, 4 and 5 show details of the construction of the table 10. FIG. 3 is a bottom plan view of the folded table illustrated in FIG. 2. As shown in FIG. 3, the legs 18*a* and 18*b*, which are fixedly secured to end section 14, have a greater distance therebetween than legs 20*a* and 20*b* attached to end section 16. This arrangement allows each of the legs 18*a*, 18*b*, 20*a* and 20*b* to rotate with end sections 14 and 16 so that each of the legs abuts the bottom of central planar section 12 when the table 10 is folded to its second position. Thus, when the table is in the folded position as shown, legs 18*a* and 18*b* are adjacent and parallel to legs 20*a* and 20*b* respectively.

As seen in FIG. 4, end sections 14 and 16 are hingedly secured to central planar section 12. A piano hinge 28*a* is utilized to connect end section 14 to central planar section 12; likewise a piano hinge 28*b* is used to connect end section 16 to central planar section 12. FIG. 4 also illustrates the manner of connecting legs 18*b* and 20*b* to end sections 14 and 16, it being understood that legs 18*a* and 20*a* are connected in identical fashion. Leg 18*b* is connected to end section 14 by means of a block 26*b*. Block 26*b* may be constructed of any suitable material, such as wood. Block 26*b* is fixedly secured to end section 14 by means of screws, nails, staples, or any other acceptable affixing means. Leg 18*a* is in turn attached to block 26*b*, also by means of screws, nails, staples, or any other affixing means. Leg 20*b* is attached to end section 16 by means of block 24*b* in the same fashion as described with respect to leg 18*b*. In this manner, the legs 18*a*, 18*b*, 20*a* and 20*b* may be fixedly secured to each of end sections 14 and 16 so that the affixing means is not visible from the outside of the table.

FIG. 5, which is a detail sectional view taken along line 5—5 of FIG. 3, illustrates the cooperation between legs 18*a* and 18*b*, and 20*a* and 20*b* when the table is in its folded position. As can be seen, the face of leg 18*a* abuts the face of leg 20*a*, and the face of leg 18*b* abuts the face of leg 20*b*. Thus, while the legs are adjacent and parallel to each other, they may also abut. This arrangement of the legs aids in stabilizing table 10 when it is in its folded position. FIG. 5 also aids in illustrating the manner in which leg 20*a* is connected to block 24*a* and in which leg 20*b* is connected to block 24*b*.

Each of the legs 18*a*, 18*b*, 20*a* and 20*b* has a length and width as shown. The length of the legs may be altered to provide the desired table height when the table is in its first position. However, the length of each of the legs 18*a*, 18*b*, 20*a* and 20*b* cannot exceed the width of central planar section 12 otherwise the table will not be foldable. Preferably, the legs 18*a*, 18*b*, 20*a* and 20*b* each have a length such that the table 10 will accommodate one or more standard height dining chairs when table 10 is in its first position. The width of the legs may also be altered to change the width of the sides of the table when it is in its second position. For example, increasing the width of each of the legs 18*a*, 18*b*, 20*a* and 20*b* also increases the width of the side of the table, as shown at 18*a* in FIG. 2, when the table 10 is in its folded position.

Likewise, the width of end sections 14 and 16 may be altered to increase or decrease the overall size of the top of table 10 when it is in its first position. This also increases or decreases the height of the table 10 when it is in its second position. It should be understood, however, that the width of the legs 18*a*, 18*b*, 20*a* and 20*b* cannot exceed the width of the end sections 14 and 16.

FIG. 6 illustrates another embodiment of the present invention. FIG. 6 illustrates a table 30 in its first position comprised of a central planar section 32 and two end sections 34 and 36. End section 34 has fixedly secured thereto a pair of legs 38*a* and 38*b*. End section 36 has fixedly secured thereto a pair of legs 40*a* and 40*b*. As can be seen from FIG. 6, the width of end section 36 is considerably greater than the width of end section 34. However, the width of legs 40*a* and 40*b* is the same as the width of legs 38*a* and 38*b*. Ideally, the width of end section 36 is twice the width of the legs.

As before, end sections 34 and 36 are hingedly secured to central planar section 32 at locations 42*a* and 42*b*. As seen in FIG. 10, end section 34 is hingedly secured to planar section 32 by means of piano hinge 44*a*. End section 36 is hingedly secured to central planar section 32 by means of piano hinge 44*b*.

FIG. 7 illustrates the unique manner in which the table is foldable from the first position to the second position. When it is desired to change the position of the table from the first position, shown in FIG. 6 to the second position, shown in FIG. 7, end section 34 and legs 38*a* and 38*b* attached thereto are first folded underneath the table so that the edges of legs 38*a* and 38*b* abut the bottom of central planar section 32 and so that end section 34 is substantially perpendicular to central planar section 32. Then, end section 36 is folded so that legs 40*a* and 40*b* fold under and abut legs 38*a* and 38*b*, and so that end section 36 is substantially perpendicular to central planar section 32. In this manner, the legs 40*a* and 40*b* form the base of the table 30. As seen in FIG. 7, when the table is folded, legs 38*a* and 40*a* collectively form one side of the table, and legs 38*b* and 40*b* collectively form another side of the table. A third side is formed by end section 36. The fourth side is partially open, the end section 34 forming the partially open side having an opening 46 to the underside of the table.

FIG. 8 illustrates another embodiment of the table 30. This embodiment is formed by altering the length of legs 38*a*, 38*b*, 40*a* and 40*b* as shown. Thus, the length of legs 38*a'*, 38*b'*, 40*a'* and 40*b'* *is somewhat less than the length of the legs* 38*a*, 38*b*, 40*a* and 40*b*. In this manner, a cantilevered cocktail table is formed when the table is folded to its second position. However, the table has substantially the same shape as shown in FIG. 6 when it is in its first position.

FIGS. 9 and 10 illustrates further construction details of the embodiment shown in FIGS. 6, 7 and 8. FIG. 9 is a detail sectional view taken along line 9—9 of FIG. 7. As seen in FIG. 9 when the table is in the second position, legs 38*a* and 38*b* rest upon legs 40*a* and 40*b*. Thus, legs 38*a* and 40*a* collectively form one side of the table and legs 38*b* and 40*b* collectively form the other side of the table. These sides assist in supporting central planar section 32. As further shown in FIG. 9, end section 36 is hingedly secured to central planar section 32 by piano hinge 44*b*. Although it is not shown, end section 34 is likewise hingedly secured to central planar section 32 by means of a piano hinge 44*a*.

FIG. 10 is a detail sectional view taken along line 10—10 of FIG. 7. As can be seen, the width of end section 32 is substantially greater than the width of end section 34. Leg 40*b* is attached to end section 36 and leg 38*b* is attached to end section 34. The width of end section 36 is preferably equal to the combined widths of legs 38*b* and 40*b*. In the preferred embodiment, legs 38*b* and 40*b* have substantially the same width, so therefore the width of end section 36 is substantially twice the width of end section 34.

As can be seen in FIGS. 6, 7 and 10, the legs 40*a* and 40*b* are attached to end section 36 at a location adjacent the outside longitudinal edge thereof. Thus, there is a space between the inside edge of legs 40*a* and 40*b* and seam 42*b*. The space is provided to receive legs 38*a* and 38*b* when the table is folded, as shown in FIGS. 7 and 10.

Legs 38*a*, 38*b*, 40*a* and 40*b* may be secured to end sections 34 and 36 by suitable affixing means such as nails, screws, staples, etc.

It should be apparent that when table 30 is in its first position, as shown in FIG. 6, a table suitable for use as a standard dining table is formed. The length of legs 38*a*, 38*b*, 40*a* and 40*b* may be altered to change the height of table 30, which at the same time alters the appearance of the second position, as seen in FIG. 3. Preferably when the table 30 is in its first position, it has a height suitable for accommodating one or more standard height dining chairs.

FIGS. 11–15 illustrate still a third embodiment of the invention. Referring to FIG. 11, there is shown a table 50 in its first position. The table 50 is comprised of a central planar section 52 and end sections 54 and 56. End section 54 has fixedly secured thereto a pair of legs 58*a* and 58*b*. End section 56 has fixedly secured thereto a pair of legs 60*a* and 60*b*. As seen in FIG. 14, end section 54 is hingedly secured to central planar section 52 by means of a piano hinge 64*a* located at a location 62*a*. Likewise, end section 56 is hingedly connected to central planar section 52 by means of a piano hinge 64*b* at location 62*b*.

As before, the table illustrated in FIGS. 11–15 is convertible between two positions. The first position, shown in FIG. 11, is the standard dining table position. The second position, shown in FIG. 12, is the cocktail table or coffee table position. As seen in FIG. 12, when the table is in the second position, the sides are fully enclosed.

The legs 58*a* and 58*b* secured to end section 54 have a greater distance therebetween than the legs 60*a* and 60*b* secured to end section 56. As seen in FIG. 13, legs 58*a* and 58*b* are secured to outside edges of the end section 54. This connection may be by any means known in the art, such as a dovetail connection, a miter joint, etc. Legs 60*a* and 60*b* are attached to the bottom of end section 56 and are offset from the edges a sufficient distance to accommodate legs 48*a* and 48*b* when the table 50 is in its section position.

As seen FIG. 14, it is preferable that the width of end section 54 be substantially equal to the width of end section 56. Furthermore, as seen in FIGS. 11 and 12, it is preferable that the width of the legs 58*a* and 58*b* be equal to the width of end section 54 and that the width of legs 60*a* and 60*b* be equal to the width of end section 56.

Referring now to FIG. 15, it can be seen that when the table is in the second position, the legs 58*a* and 60*a* are adjacent and parallel to each other, and the legs 58*b* and 60*b* are adjacent and parallel to each other. The legs 58*a* and 58*b* form outer sides of the table shown in FIG. 12, while the legs 60*a* and 60*b* form inner sides of the table shown in FIG. 12. End sections 54 and 56 form additional sides of the table so that the table 50 is completely enclosed when the table 50 is in the second position.

When the table is in the first position shown in FIG. 11, the mating edges of central planar section 52 and end section 54 (seam 62*a*), and the mating edges of end section 56 and central planar section 52 (seam 62*b*) abut to maintain the table top in a horizontal position.

Preferably, the length of each of the legs 58*a*, 58*b*, 60*a* and 60*b* is substantially equal to the width of central planar section 52.

FIGS. 16–20 illustrate a fourth embodiment of the invention. This embodiment is similar to the embodiment illustrated in FIGS. 11–15, but differs in the design of the legs. As seen in FIGS. 16, 17 and 19, the legs have an ornate shape which adds to the aesthetic appearance of the table.

The table 70 is comprised of a central planar section 72 having hingedly secured thereto for rotation end sections 74 and 76. End section 74 has fixedly secured thereto a pair of legs 78*a* and 78*b*. End section 76 has fixedly secured thereto a pair of legs 80*a* and 80*b*. As seen in FIG. 18, the legs 78*a* and 78*b* are secured to outside edges of end section 74 by any means known in the art, such as a dovetail joint, miter joint, etc. The distance between legs 78*a* and 78*b* is somewhat greater than the distance between legs 80*a* and 80*b*. Accordingly, legs 80*a* and 80*b* are mounted on the bottom of end section 76 at locations offset from the outside edges of end section 76. Accordingly, when the table is folded into the position shown in FIG. 17, legs 78*a* and 80*a* are parallel and adjacent to each other and legs 78*b* and 80*b* are parallel and adjacent to each other. Thus, when the table is in the second position, legs 78*a* and 78*b* form outer sides of the table and legs 80*a* and 80*b* form inner sides of the table.

End sections 74 and 76 are hingedly secured to central planar section 72 at locations 82*a* and 82*b* respectively by means of piano hinges 84*a* and 84*b*. As before, when the table 70 is in the first position (FIG. 16), the mating edges of end section 74 and central planar section 72, and the mating edges of end section 76 and central planar section 72 abut at 82*a* and 82*b* respectively to maintain end sections 74 and 76 and central planar section 72 in the same plane.

Referring to FIG. 17, it can be seen that due to the ornate shape of the legs 78*a*, 80*a*, there is an opening 86*a* into the side of the table. As seen in FIG. 19, there is a similar opening 86*b* on the opposite side of the table formed by the legs 78*b* and 80*b*.

The base of the legs 78*a*, 78*b*, 80*a* and 80*b* has a width substantially equal to the width of end sections 74 and 76. However, the legs taper to a narrower width as can be seen in FIG. 16, and as shown in greater detail in FIGS. 19 and 20.

As before, it should be noted that the length of each of the legs 78*a*, 78*b*, 80*a* and 80*b* is substantially equal to the length of central planar section 32.

Preferably, the length of legs 78*a*, 78*b*, 80*a* and 80*b* is such that, when table 70 is in its first position, it has a height suitable to accommodate one or more standard height dining chairs.

The tables described above may be constructed of any suitable material such as wood, metal, fiberglass, etc. Other table designs are possile utilizing the inventive concept disclosed herein.

The present invention may be embodied in other specific forms without departing from the spirit or essential attributes thereof and, accordingly, reference should be made to the appended claims, rather than to the foregoing specification, as indicating the scope of the invention.

I claim:

1. A table convertible between a first position and a second position comprising:

(a) a central planar section substantially rectangular in shape, said central planar section having a lower surface defining a bottom of said table and an upper surface defining a top said table; and (b) first and second end section hingedly connected to opposite ends of said central planar section, each of said first and second end sections having different widths, the width of said second end section being greater than the width of said first end section, a first pair of legs having upper portions fixedly secured to opposite lateral edges of said first end section, a second pair of legs having upper portions fixedly secured to said second end section, at least said upper portions of said first and second pair of legs having a width substantially equal to the width of said first end section;

whereby said first and second end sections are pivotable about said hinges to a position in the same plane as said upper surface of said central section to increase the size of said top of said table, said legs supporting said table, thereby defining said first position, and said first and second end sections are pivotable about said hinges to a position substantially perpendicular to said upper surface of said central section so that said end sections and said legs form sides of said table, at least said upper portions of said first pair of legs abutting said bottom of said central planar section, said first pair of legs resting upon said second pair of legs, thereby defining said second position.

2. A table according to claim 1 wherein said width of said second end section is substantially twice said width of said first end section.

* * * * *